US006086336A

United States Patent [19]

Welschof et al.

[11] Patent Number: 6,086,336

[45] Date of Patent: Jul. 11, 2000

[54] DEVICE TO REDUCE PULSATIONS ON A HYDROSTATIC POSITIVE DISPLACEMENT UNIT

[75] Inventors: Bernward Welschof, Markt Grossostheim; Roland Angert, Pfungstadt; Richard Hofmann, Alzenau; Hans-Dieter Dörr, Ober-Ramstadt; Christian Bergmann, Rottenberg, all of Germany

[73] Assignee: Linde Aktiengesellschaft, Germany

[21] Appl. No.: 09/024,026

[22] Filed: Feb. 16, 1998

[30] Foreign Application Priority Data

Feb. 17, 1997 [DE] Germany ..... 197 06 114

[51] Int. Cl.[7] ..... F09B 49/00; F16D 31/02

[52] U.S. Cl. ..... 417/308; 417/540; 91/487; 91/489; 60/469

[58] Field of Search ..... 417/308, 540, 417/543, 269; 92/71; 91/486, 487, 489, 499; 60/469

[56] References Cited

U.S. PATENT DOCUMENTS 2,632,724 11/1944 Shea ..... 417/308
3,956,969 5/1976 Hein ..... 91/6.5

*Primary Examiner*—Charles G. Freay
*Attorney, Agent, or Firm*—Webb Ziesenheim Logsdon Orkin & Hanson, P.C.

[57] ABSTRACT

This invention relates to a device to reduce pulsations on a hydrostatic positive displacement units, such as an axial or radial piston machine working both as a pump and as a motor with a reversible direction of rotation. In the displacement units, at least one piston is mounted so that it can move longitudinally in a cylinder bore which forms a cylinder chamber. The device has a buffer element which is in communication with the high-pressure side and can be brought into connection with the cylinder chamber. The device reduces pulsations on hydrostatic positive displacement units by which the reversing actions of the cylinder chambers are optimized and the pulsations are effectively minimized in a broad bandwidth of operating conditions. A switchable valve, in particular a non-return valve which opens toward the cylinder chamber is located in a connecting channel between the buffer element and the cylinder chamber.

14 Claims, 4 Drawing Sheets

DEVICE TO REDUCE PULSATIONS ON A HYDROSTATIC POSITIVE DISPLACEMENT UNIT

BACKGROUND OF THE INVENTION

1. Field of the Invention

This invention relates to a device to reduce pulsations on a hydrostatic positive displacement unit such as an axial or radial piston machine which can be used both as a pump and as a motor with a reversible direction of rotation. The displacement unit includes at least one piston mounted so that it can move longitudinally in a cylinder bore which forms a cylinder chamber. The device has a buffer element which can be brought into communication with the cylinder chamber through a connecting channel.

The invention further relates to a device to reduce pulsations on a hydrostatic positive displacement unit which has a pre-compression device which is provided with a valve located between a low-pressure side and a high-pressure side and opens toward the high-pressure side. The pre-compression device creates a connection between the cylinder chamber and the high-pressure side as soon as the pressure in the cylinder chamber exceeds the pressure on the high-pressure side.

2. Background Information

Hydrostatic positive displacement units of this type generally have a plurality of cylinder chambers and deliver a non-constant, pulsating volume flow. One of the causes of these pulsations in the volume flow of the positive displacement unit is the result of the kinematic conditions. On such machines, the hydraulic fluid is transported by several pistons which can move longitudinally in cylinders and work according to the positive displacement principle, from the low pressure inlet side to the high pressure outlet side. As a result of the superimposition of the individual volume flows to form the total volume flow of the positive displacement unit, there is a pulsation in the flow being transported. This type of pulsation is designated a kinematic pulsation.

An additional cause of the pulsations is the kinetic pulsation which originates from the compressibility of the medium being transported, and which occurs primarily when there are large pressure differentials between the inlet side and the outlet side. This type of pulsation is caused by pressure equalization currents which occur during the reversal actions of the cylinder chambers from the inlet side to the outlet side. If, for example, a cylinder chamber of a rotating cylinder drum is moved from the inlet side, which is under low pressure, to the outlet side, which is under high pressure, at the corresponding dead center position of the movement of the piston, the cylinder chamber traverses an area in which the cylinder chamber is briefly not in communication with either the low pressure side or the high pressure side. When communication is subsequently established between the cylinder chamber and the high-pressure side, volume flows occur as a result of the pressure differential between the cylinder chamber and the high-pressure side. As the cylinder chambers move further, the cylinder chamber also traverses an area in which the cylinder chamber is not connected to the high-pressure side or the low-pressure side. Large pressure differentials also occur when it is reversed to the low-pressure side. Consequently, pulsations originate which result in vibrations and noises in the positive displacement unit.

To reduce the pulsation, the prior art teaches measures which provide an adaptation of the pressure in the cylinder chambers to the pressure at an outlet side which is under high pressure by the kinematics of the piston. The adaptation of the pressure can be achieved, for example, by a pre-compression of the cylinder chamber. In this case, a pre-compression device is located between the inlet side and the outlet side, whereby the pressure of the hydraulic fluid contained in the cylinder chambers is increased by the piston stroke, before the cylinder chamber is placed in communication with the outlet side.

A hydraulic axial piston machine of this type is disclosed in DE 33 19 822. The pump has a low-pressure inlet side and a high-pressure outlet side, whereby there is a pre-compression zone between the low-pressure side and the high-pressure side. In this pre-compression zone, there is a connecting channel which creates a connection between the cylinder chambers and the outlet side. Located in this connecting channel is a valve which opens toward the outlet side and prevents the pressure in the cylinder chambers as a result of the pre-compression from increasing to excessive levels which could damage or destroy the machine.

As the cylinder drum moves from the inlet side to the outlet side, the cylinder chamber moves through the pre-compression zone, as a result of which the pressure in the cylinder chamber is increased by the piston stroke. As soon as the cylinder chamber exposes the opening to the connecting channel, fluid flows through the connecting channel and the valve into the outlet side if the pressure in the cylinder chamber exceeds the pressure on the outlet side. The pressure in the cylinders is thus limited to the pressure at the outlet. As the cylinder chamber moves further, it is opened toward the outlet side.

Under these conditions, the valve opens as soon as the pressure resulting from the pre-compression in the cylinder chambers equals the pressure on the outlet side. In positive displacement units with adjustable stroke volumes which work against pressures on different levels on the high-pressure side, the pre-compression zone must be realized so that the pressure can be increased to the maximum operating pressure of the machine. For this purpose, the pre-compression zone between the inlet side and the outlet side must have a corresponding length to make possible a pre-compression to the maximum operating pressure.

If only a low pressure is applied to the outlet side, losses occur on account of the pre-compression of the cylinder chambers, as a result of which the hydrostatic positive displacement unit operates with poor efficiency.

A pressure equalization between the cylinder chambers and the high-pressure side can also be achieved only if the pressure resulting from the pre-compression in the cylinder chambers exceeds the pressure on the high-pressure side and thus opens the valve.

To reduce pulsation, the prior art further discloses the use of a buffer element which effects an equalization between the pressure in the cylinder chambers and the pressure on the high-pressure side.

A hydrostatic machine utilizing the axial piston design with such a buffer reversal is described in DE 42 29 544. On this machine, there is a buffer element in the form of an oil-filled pre-compression volume which is placed in communication with the cylinder chamber after the cylinder chamber has passed the dead center position by means of a connecting channel and an opening in the control plate. Hydraulic fluid is thereby extracted from the pre-compression volume, as a result of which the pressure in the cylinder increases. The pre-compression volume is filled via a line which is in communication with the high-pressure side of the machine.

The pre-compression volume is supplied with fluid via a constant connection between the pre-compression volume and the outlet side of the machine. If a cylinder space moves from the inlet side to the outlet side, and if low pressure is applied to the inlet side and high pressure to the outlet side, hydraulic fluid is extracted from the pre-compression volume as soon as the cylinder chamber has exposed the opening in the control plate. As a result of this measure, the pressure in the cylinder chambers is equalized to the pressure of the outlet side, whereupon lower volume flows are formed to equalize the small remaining pressure difference when the cylinder chambers are connected to the outlet side. With this measure, however, a specially designed cylinder nodule is required to connect the cylinder chambers with the pre-compression volume, to make it possible for the hydraulic fluid to flow rapidly from the pre-compression volume into the cylinder chamber.

The prior art also includes the recharging of the pre-compression volume during the period in which the cylinder space is in communication with the high-pressure side. To fill the pre-compression volume only a temporary communication with the high-pressure side is established. For this purpose, a specially shaped cylinder nodule is required. While the cylinder chamber is in communication with the pre-compression volume, this cylinder nodule first briefly establishes communication between the cylinder chamber and the pre-compression volume. During this period, the pressure in the cylinder is increased. Then the communication is interrupted. In a further phase, an increasingly large cross section is formed which makes it possible to fill the pre-compression volume as soon as the cylinder is in communication with the high-pressure side.

In these measures with a buffer reversal, the cylinder chamber is placed in communication with the pre-compression volume only briefly. Only a short period of time is therefore available for the required pressure equalization. The time during which the cylinder chamber is in communication with the space via the connecting channel is controlled by the geometry of the connecting line and of the cylinder nodule. The optimum opening time must thereby be considered the time during which a pressure equalization can take place between the cylinder chamber and the pre-compression volume. This opening time is a function of the operating parameters, such as the speed of rotation, the operating pressure and the displacement position. The opening time with these measures is defined by the geometry of the components, which means that an effective reduction of pulsations is not achieved under all operating conditions.

A further disadvantage of these measures is that a correspondingly large pre-compression volume must be provided to achieve an effective reduction of pulsations. However, such a large pre-compression volume requires a correspondingly large amount of room in the machine in which it can be located.

SUMMARY OF THE INVENTION

The object of this invention is to improve the measures known from the prior art so that the reversing processes of the cylinder chambers from the inlet side to the outlet side can be further optimized, and the pulsations can be effectively minimized in a broad bandwidth of operating conditions. The above object can be accomplished on positive displacement units with a buffer reversal by increasing the capacity of the buffer element compared to the capacity of an oil-filled buffer element and/or by providing at least one additional connecting channel which connects the cylinder chambers with the buffer element or with a control nodule of the positive displacement unit, and wherein a throttling device is located in the additional connecting channel.

The pulsation-reducing effect of a buffer element increases with the capacity of the buffer element. To effectively reduce the pulsations, it would therefore be necessary to provide the buffer element with a corresponding large volume of hydraulic fluid. Such a measure, however, would require a significant amount of space for the installation of the buffer element on the positive displacement unit.

The capacity of a buffer element is a function of the volume and the modulus of compression of the media it contains. It therefore becomes possible to increase the capacity of the buffer element by changing the modulus of compression. It becomes possible, with the same damping and thus pulsation-reducing action, to reduce the amount of space required for the installation of the buffer element of the present invention compared to an oil-filled buffer element of the prior art. Alternatively, given an installation space of the same size, an increase in capacity results in the improved reduction of pulsations.

Tests have also shown that the reversing actions can be improved, and therefore the pulsation can be reduced if there is at least one additional connecting channel which connects the cylinder chamber to the buffer element, and in which a throttling device is located.

On a positive displacement unit which is working as a pump, when reversing from the low pressure inlet side to the high pressure outlet side, by a plurality of connecting channels it is possible to increase the length of time which is available for the pressure equalization between the cylinder chamber and the buffer element so that an effective damping of pulsations becomes possible in a broad bandwidth of operating conditions. The buffer element can hereby be refilled via a plurality of throttling connecting channels. Consequently, the length of time available to fill the buffer element is also increased. At high relative velocities of the cylinder chamber between the inlet-side and the outlet side, a pressure equalization between the buffer element and the cylinder chambers thereby becomes possible, as well as a satisfactory filling of the buffer element. By appropriate selection of the throttling devices in the connecting channels, the filling action of the buffer element can be varied, for example to make possible a very slow filling of the buffer element. The reversing action on a pump which also works as a motor, whereby the inlet side is pressurized at high pressure and the outlet side at low pressure, can also be improved. In this type of operation, the buffer element which, during pump operation, is in communication with the outlet side absorbs hydraulic fluid from the cylinder chamber. As a result of the further movement toward the outlet side, when the unit is operating as a motor, the pressure in the cylinder chamber decreases further, so that it is also possible to improve the reversing processes from the high pressure side to the low pressure side. The buffer element for operation of the unit as a pump can therefore also improve the reversing action when the unit is operating as a motor.

In the present invention, the noise behavior of a hydraulic positive displacement unit can also be improved if there is an additional connecting channel which connects the cylinder chamber with a control nodule of the positive displacement unit. On a positive displacement unit, e.g. a pump, which has a buffer element which is in communication with the outlet control nodule, the pulsations which occur on the occasion of the reversal can be reduced by an additional connecting channel in the control plate which is also in communication with the outlet control nodule. As a result of a suitable location of the opening of the additional connecting channel in the control plate of the positive displacement unit, it is possible to superimpose the kinetic pulsation and the kinematic pulsation so that there is a smoothing of the pulsation which consists of the combined kinematic and kinetic components.

In one configuration of the invention, the buffer element is a hydropneumatic buffer. The hydropneumatic buffer may be a gas buffer with a membrane which separates the space containing oil from the space containing the gas. As a result of the use of a hydropneumatic buffer, the capacity of the buffer element is increased compared to the capacity of an oil-filled buffer element of the prior art. It is therefore possible to install a buffer element with a larger capacity in a specified amount of space, or to reduce the amount of space required compared to the space required for a prior art oil-filled buffer element, whereby the same capacity of the buffer element and thus the same pulsation-reducing effect can be achieved.

It is also possible to increase the capacity of the buffer element if the buffer element has an oil-filled space with a flexible containment wall. A further increase in the capacity is hereby achieved if the flexible containment wall of the buffer element is under a gas prestress, or gas pressure for a surrounding chamber.

In a further configuration of the invention, the buffer element has an oil-filled space, wherein flexible elements, in particular plastic elements, are inserted into the space. This arrangement also makes it possible to increase the capacity of the buffer element, as a result of which there is an improved reduction of pulsations.

The object described above can also be accomplished on positive displacement units with a pre-compression device and a valve which opens toward the high-pressure side, which creates a connection between the cylinder chambers and the high-pressure side, by locating a throttling device parallel to the valve in the connecting channel.

The connection of the cylinder chamber with the high-pressure side in one embodiment of the present invention is via the valve and via the throttling device. The invention thereby makes it possible for hydraulic fluid to flow from the cylinder chamber into the high-pressure side by the non-return valve, and by the throttling device. When the positive displacement unit is operated as a pump, it thereby becomes possible to adjust the pressure in the cylinder chambers to the pressure on the outlet side, if the pressure in the cylinder chambers is less than the pressure on the outlet side. The pressure in the cylinder chambers can thereby be adjusted to the pressure on the outlet side under many different operating conditions. The reversing actions from the low-pressure side to the high-pressure side are improved, which results in fewer pulsations in the positive displacement unit, and therefore the positive displacement unit can be operated with less noise and fewer vibrations. The invention also makes it possible to reduce the length of the pre-compression zone, because the pressure in the cylinder chambers need not be compressed to the maximum operating pressure of the positive displacement unit.

On positive displacement units in which the pre-compression device is a pre-compression zone and has a connecting channel which is in communication with the high-pressure side, the present invention provides that the connecting channel has two channel segments which are oriented parallel to one another, whereby the valve is located in a first channel segment and the throttling device in a second channel segment. The valve and the throttling device can thereby be combined into a single one-way restrictor, which facilitates installation in the control plate of a positive displacement unit, for example. In this configuration, at least one additional connecting channel may be provided with a throttling device branching off from the connecting channel.

As a result of the reversal from the inlet side to the outlet side by a plurality of connecting channels, it becomes possible to form the pre-compression zone so a that the pressure in the cylinder chambers is increased to a pressure which is less than the maximum operating pressure. The pre-compression of the present invention thereby makes possible an efficiency which represents an improvement over the solutions of the prior art. Under operating conditions in which the pressure on the outlet side exceeds the pressure in the cylinder chambers, the pressure equalization with the outlet side occurs by the throttling connecting channels. The length of time which is available for the equalization of pressure between the cylinder chamber and the outlet side can be increased by the use of a plurality of connecting borings, so that pulsations during reversal are reduced. The throttling device may be an orifice. It is also possible, however, to use a throttle boring.

A pilot notch may be located on the connecting channel. The differential between the pressure in the cylinder chamber and the pressure which occurs in the connecting channel is gradually reduced, as a result of which there is a further improvement in the reversal action both in the event of a buffer reversal and in the event of a valve reversal.

The invention can be used both in positive displacement units which employ the axial piston design with a rotating cylinder drum, such as an axial piston machine having an oblique plate or swash plate, and also in positive displacement units with a rotating control plate, which are sometimes called swash plate or wobble plate machines. The invention can also be used in radial piston machines both with internal and also with external pressurization.

Additional advantages and details of the invention are explained in greater detail below with reference to the embodiments which are illustrated in the accompanying schematic drawings.

DETAILED DESCRIPTION OF THE PREFERRED EMBODIMENTS

Figure 1:
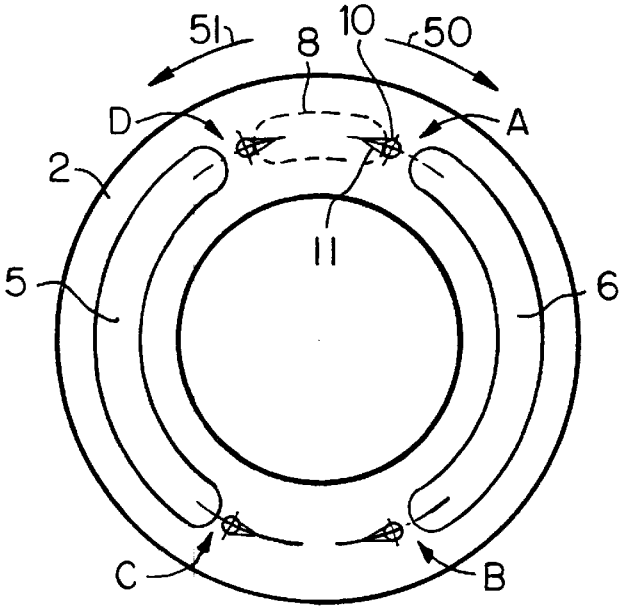
FIG. 1 is a schematic plan view of a control plate of an axial piston machine.

FIG. 1 shows a plan view of the control plate 2 of an axial piston machine with two control nodules 5, 6, each of which can be brought into communication with the low-pressure side and the high-pressure side of a hydraulic circuit, as a result of which the positive displacement unit can be operated both as a pump and as a motor. The cylinder chambers 4 of the axial piston machine, on the side facing the control plate 2, each have a kidney-shaped control slot 8 which is in alternating communication with the control nodules 5, 6 as a result of the rotational movement of the cylinder drum relative to a stationary control plate 2 or the movement of the control plate 2 relative to a stationary cylinder block or cylinder drum. When the cylinder drum moves in the direction 51, the cylinder chamber moves from the control nodule 5 forming the low-pressure side of a hydrostatic circuit to the control nodule 6 forming the high-pressure side. If the control nodule 5 is the hydraulic fluid inlet and the control nodule 6 a hydraulic fluid outlet, the positive displacement unit works as a pump. If, with the same hydraulic fluid inlet and hydraulic fluid outlet, the control nodule 5 is connected to the high-pressure side and the control nodule 6 to the low-pressure side of the circuit, the positive displacement unit is operated as a motor. A reversal of the direction of rotation can also be made on an axial piston machine which is operated in only one direction of rotation by pivoting a swash plate by its center axis, which lies perpendicular to the axis of rotation.

In the vicinity of the web which separates the control nodules 5 and 6, in the area A of the control nodule 6 there is a connecting channel 10, in which a pilot notch 11 can also be located. On a positive displacement unit with a buffer reversal, the connecting channel 10 is in communication with a buffer element. On a pump which is operated in the direction 50 and transports hydraulic fluid sucked out of the control nodule 5 and into the control nodule 6, the hydraulic fluid is compressed in the cylinder chamber 4 to approximately the pressure at the control nodule 6, as soon as the cylinder chamber 4 exposes the connecting channel 10 in the control plate. The reversing action from the low-pressure side to the high-pressure side is thereby improved. For such a positive displacement unit operating in single-quadrant operation, it is sufficient to locate one buffer element between the low-pressure control nodule and the high-pressure control nodule. A buffer element can be in the same location when the positive displacement unit is operated purely as a motor.

If the pump, with the same direction of rotation, is also used as a motor, in which case the control nodule 6 is pressurized with low pressure and the control nodule 5 with high pressure, in area C of the control nodule 5, there is a corresponding connecting channel with a buffer element. The buffer element located in area A thereby simultaneously improves the reversing action from the high-pressure side to the low-pressure side. If the positive displacement unit also has a swash plate which can be adjusted by the center position, the inlet side and the outlet side are thereby switched, and the direction of rotation is reversed. With the buffer elements located in areas A and C, the reversing action for such a positive displacement unit which is working in four-quadrant operation is thereby also improved, both from the low-pressure side to the high-pressure side and also from the high-pressure side to the low-pressure side. If, on a positive displacement unit, the cylinder chambers are moved in the direction 50 to reverse the direction in which the hydraulic fluid is being transported, there are additional corresponding buffer elements in the areas B and D, to make it possible to reduce pulsations for four-quadrant operation of the positive displacement unit.

Each of the two or four buffer elements of a positive displacement unit working in four-quadrant operation is the same as the single buffer element of a positive displacement unit working in single-quadrant operation. The following description relates to the location of a buffer element in the area A of the control nodule 6. The buffer element, however, can also be located in areas B, C or D, or in a plurality of areas, depending on the manner in which the positive displacement unit is operated.

On a positive displacement unit with a pre-compression reversal, the area between the control nodules 5 and 6 is a pre-compression zone. The control nodule 5 is pressured with low pressure, for example, and the control nodule 6 with high pressure. The connecting channel 10 located in the area A has a non-return valve which opens toward the control nodule 6, with a throttling device oriented parallel to it. If the positive displacement unit is operated as a pump in the direction 50, the pressure in the cylinder chambers is equalized to the pressure of the control nodule 6, whereby when there is a pressure in the cylinder chambers which is higher than the pressure on the outlet side, the non-return valve opens. Under operating conditions in which the pressure which results from the pre-compression in the cylinder chambers is less than the pressure at the control nodule 6, the pressure can be equalized by the throttling device. When the positive displacement unit is simultaneously operated as a motor with the same direction of rotation, a one-way restrictor valve is also provided in the area C of the control nodule 5 to improve the reversal from the low-pressure side to the high-pressure side. On an axial piston machine with a swash plate which can be adjusted in the opposite direction, the presence of these two devices makes it possible to reduce pulsations in four-quadrant operation. In four-quadrant operation which results from a reversal in the direction of rotation of the cylinder drum to direction 51, there are additional connecting channels with one-way restrictor valves in areas B and D. On a positive displacement unit with a pre-compression device, each one-way restrictor valve used for four-quadrant operation is the same as the one-way restrictor valve used for single-quadrant operation.

Figure 2:
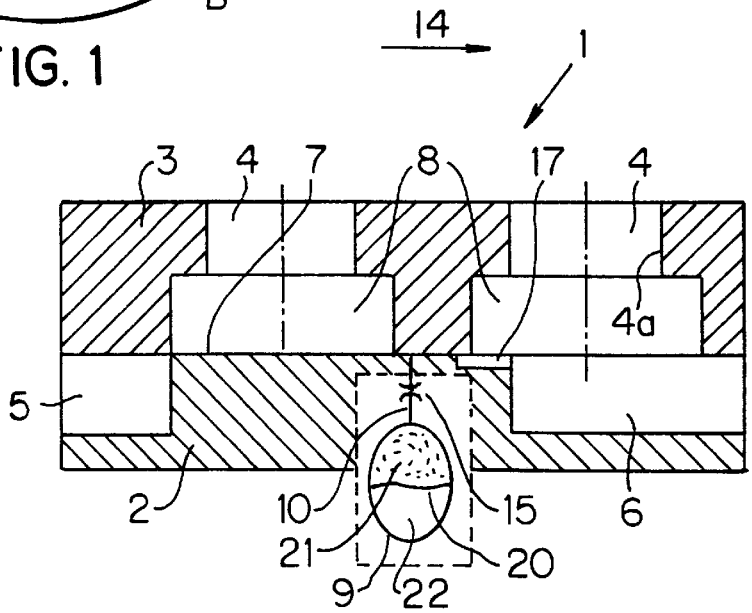
FIGS. 2 and 3 show a cross-section through a control plate with a schematic view of buffer elements according to the present invention which has an increased capacity.

FIG. 2 shows a cross-section through a hydrostatic positive displacement unit, such as an axial piston machine with a control plate 2 and a cylinder drum 3. The cylinder drum 3 has a plurality of cylinder bores 4*a*, in which pistons (not shown) are mounted so that they can move longitudinally, and which form cylinder chambers 4. On the control plate 2 there is an inlet side and an outlet side in the form of control nodules 5, 6 whereby, for example, the inlet side is in communication with the low-pressure side and the outlet side is in communication with the high-pressure side of a hydraulic circuit. Under these conditions, the axial piston machine therefore works as a pump. If the low-pressure side is in communication with an unpressurized container, the pump works in an open circuit.

When the cylinder drum 3 moves relative to the control plate 2, by rotation of the cylinder drum 3 relative to a stationary control plate 2 or by the rotation of control plate 2 relative to a stationary cylinder block 3, the cylinder chambers 4 are alternately placed in communication with the low-pressure control nodule 5 and the high-pressure control nodule 6 of the control plate 2. Between the control nodules 5 and 6 there is a web 7 which separates the two control nodules 5, 6 and is located in the vicinity of the dead center positions of the longitudinal movement of the pistons. The cylinder chambers 4, on the side facing the control nodules 5, 6, have control slots 8 which can be kidney-shaped.

Between the control nodules 5 and 6 there is a buffer element, the purpose of which is to damp pulsations by equalizing the pressure of the fluid in the cylinder chambers 4 to the pressure on the outlet side.

For this purpose there is a connecting channel 10 which extends from the buffer element 9 to the web 7 of the control plate 2. In the connecting channel 10 there is a constriction which forms a throttle 15, which can be used to influence the volume of the flow through the connecting channel 10. The buffer element is thereby filled during the period in which the cylinder chamber 4 is in communication with the high-pressure control nodule 6 and the connecting channel 10.

If the cylinder drum 3 moves in the direction 14, for example from the low-pressure side to the high-pressure side of the positive displacement unit 1, in a first phase of the movement fluid flows into the cylinder chambers 4 as soon as the control slots 8 of the cylinder chambers 4 are in communication with the low-pressure control nodule 5. In a further phase of the movement, the control slot 8 of the cylinder closes the connection to the low-pressure control nodule 5. As soon as the control slot 8 exposes the mouth to the connecting line 10, hydraulic fluid flows out of the buffer element 9 into the cylinder chamber 4, as a result of which the pressure in the cylinder chamber 4 is equalized to approximately the pressure on the outlet side. As the cylinder drum 3 moves further, the control slot 8 of the cylinder chamber 4 comes into communication with the high-pressure control nodule 6, so that the hydraulic fluid contained in the cylinder chambers 4 is transported to the high-pressure side of the positive displacement unit 1. As a result of the use of pilot notches 17 on the high-pressure control nodule 6, any remaining pressure differential between the cylinder chambers 4 and the high-pressure control nodule 6 is slowly reduced. The reversal from the low-pressure side to the high-pressure side of such a positive displacement unit realized in the form of a pump is thereby improved. When the positive displacement unit is operated as a motor, i.e. with the control nodule 5 under high pressure and the control nodule 6 under low pressure, the buffer element 9 takes on hydraulic fluid from the cylinder chambers 4, so that the pressure in the cylinder chambers 4 is equalized to the pressure on the outlet side. The buffer element 9 is emptied during the period in which the control slot 8 exposes the control nodule 6 and simultaneously the connecting channel 10. The reversing action from the high-pressure side to the low-pressure side is thereby also improved.

The buffer element 9 is a hydropneumatic buffer, e.g. in the form of a membrane buffer. A membrane 20 separates the buffer into two chambers, whereby a first chamber 21 is filled with hydraulic fluid and a second chamber 22 is filled with gas, e.g. nitrogen. A buffer which occupies significantly less space can be used to achieve the same damping action as a buffer which is filled entirely with oil. Consequently, the space required for a buffer element of the present invention can be reduced in size, or the same amount of space can be used to achieve an improved pulsation-reducing action on the positive displacement unit.

Figure 3:
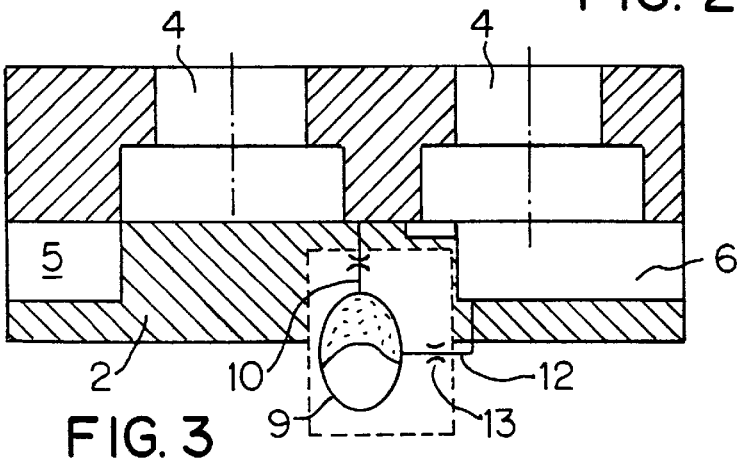

The feeding or emptying of the hydropneumatic buffer can take place as illustrated in FIG. 3 by means of a channel 12 and a throttle 13 which is in constant communication with the outlet side. The throttle 13 can also be used to influence the volume flow for filling the buffer element 9.

Figure 4:
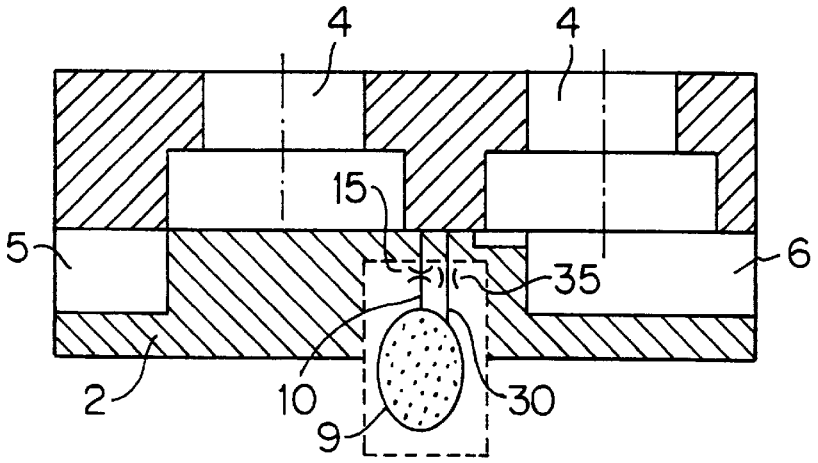
FIGS. 4 and 5 schematically show buffer elements according to the present invention with a plurality of connecting channels which connect the buffer element to the cylinder chamber, similar to the view illustrated in FIG. 2.
Figure 5:
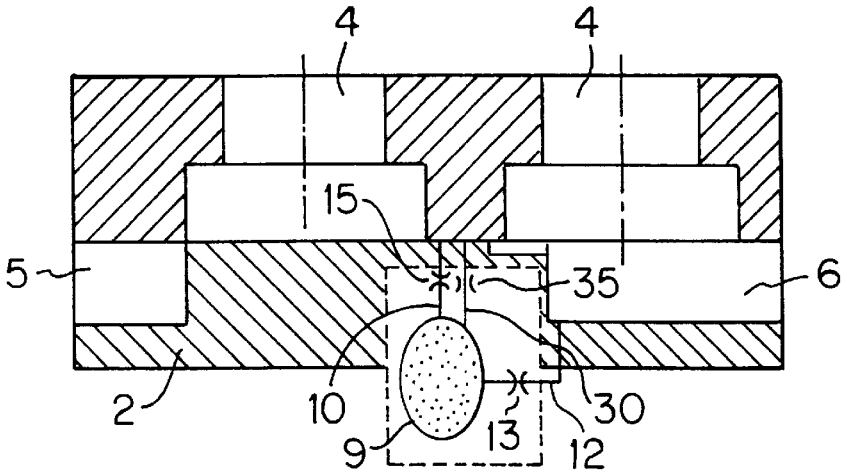

FIGS. 4 and 5 illustrate a further measure which can be employed to reduce pulsations. In the control plate 2 there are a plurality of connecting channels 10 and 30 which connect the buffer element 9 to the cylinder chamber 4. Each connecting channel 10, 30 has a throttle 15 and 35 respectively. In this case, the buffer element 9 can be either in intermittent communication with the control nodule 6 illustrated in FIG. 4, or in constant communication through channel 12 and throttle 13 as illustrated in FIG. 5. The length of time which is available for pressure equalization with the cylinder chambers and for filling and emptying the buffer element 9 is increased by the use of a plurality of connecting channels 10, 30. In addition, the selection of a different throttle cross section of the throttles 13, 35 can result in a gradual equalization of the pressure in the cylinder chambers. The pressure in the cylinder chambers can thereby be increased, for example, to approximately the pressure on the high-pressure control nodule 6, without losing the pulsation-reducing effect of the buffer element 9.

Figure 6:
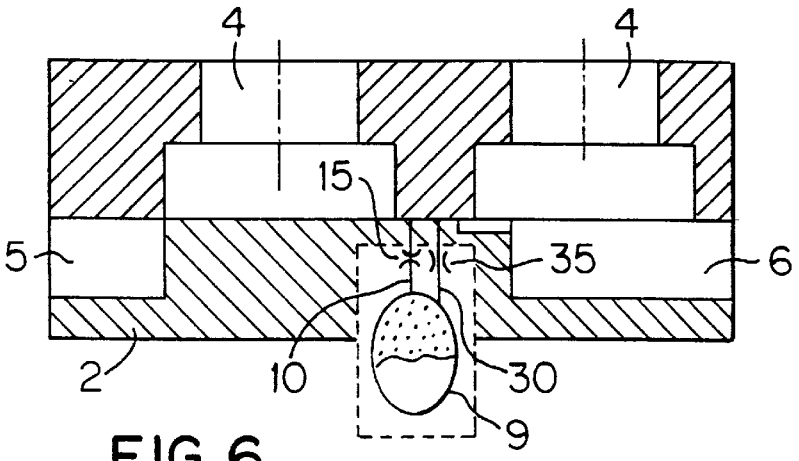
FIGS. 6 and 7 schematically show buffer elements according to the present invention with an increased capacity and a plurality of connecting channels which connect the buffer element to the cylinder space, similar to the view shown in FIG. 2.
Figure 7:
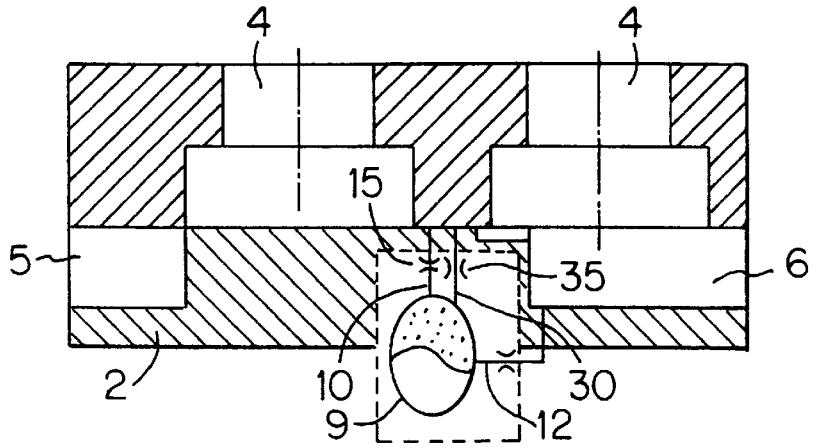

The combination of a buffer element 9 with an increased capacity and an additional connecting channel 30 which makes it possible to connect the buffer element 9 with the cylinder chamber 4 is illustrated in FIGS. 6 and 7. A plurality of connecting channels 10, 30 also significantly improve the reversing action for buffer elements with an increased capacity. The buffer element 9 can be in intermittent communication (FIG. 6) or in constant communication through channel 12 and throttle 13 (FIG. 7) with the outlet side control nodule 6.

Figure 8:
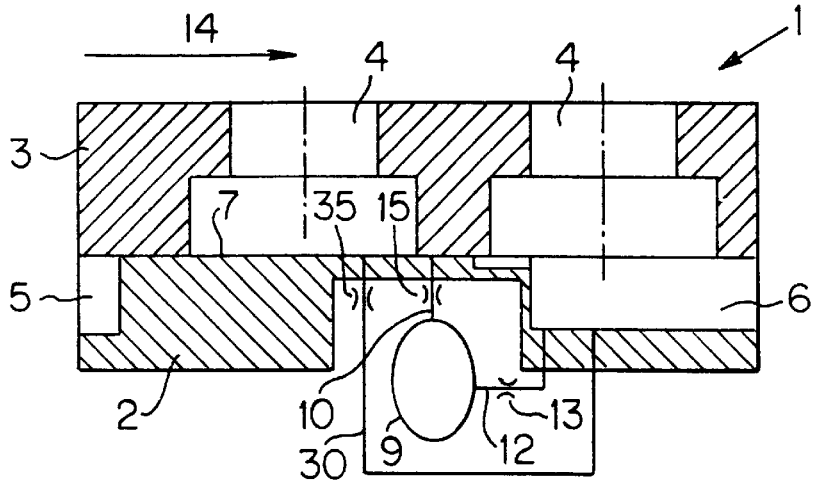
FIG. 8 schematically shows a buffer element according to the present invention and a connecting channel which makes possible a connection between the cylinder chamber and a control nodule.

FIG. 8 shows an additional measure which can be employed to reduce noise and vibrations in hydraulic positive displacement units. In addition to the buffer element 9 which is in communication via the connecting channel 10 with the cylinder chamber 4, there is an additional connecting channel 30 which connects the cylinder chamber to the control nodule 6. Through suitable layout of the connecting channels 10 and 30 in the control plate 2, it is possible to superimpose the kinematic component of the pulsation on the kinetic component of the pulsation, so that the pulsation which consists of the combination of the kinetic and the kinematic components is smoothed. In this case, the connecting channels 30 and 10 can be switched with regard to their positions on the control plate, so that when there is a movement in the direction 14, the cylinder chamber 4 first exposes the opening to the connecting channel 10 and to the buffer element 9. There can also be additional connecting channels to connect the buffer element to the cylinder chamber 4. It is also possible to provide the buffer element with an increased capacity.

Figure 9A:
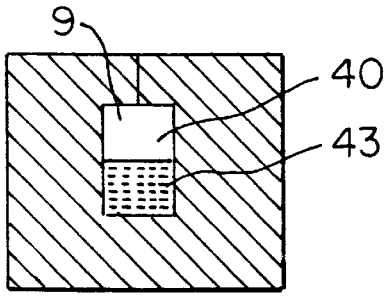
FIGS. 9*a* and 9*b* show additional embodiments of buffer elements according to the present invention.
Figure 9B:
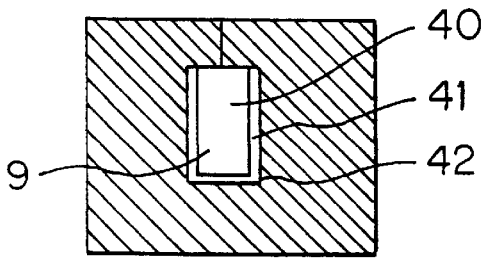

FIGS. 9*a* and 9*b* show additional configurations of the buffer element 9. In FIG. 9*a,* the buffer element is an oil-filled chamber 40, into which flexible elements 43 are inserted. These elements can be made of plastic. The capacity of the buffer element 9 is increased, which results in a reduction of the amount of space required for the installation of the buffer and in an improvement of the reversing actions compared to a buffer element filled with oil.

The buffer element 9 illustrated in FIG. 9*b* has an oil-filled chamber 40 which is bounded by a flexible wall 41. The capacity of the buffer element 9 is thereby increased. If the flexible wall is under a gas prestress or gas pressure from chamber 42, it is possible to further increase the capacity of the buffer 9. The pulsations on the positive displacement unit are thereby effectively reduced, as a result of which there are also fewer vibrations and less noise generated by the positive displacement unit.

Figure 10:
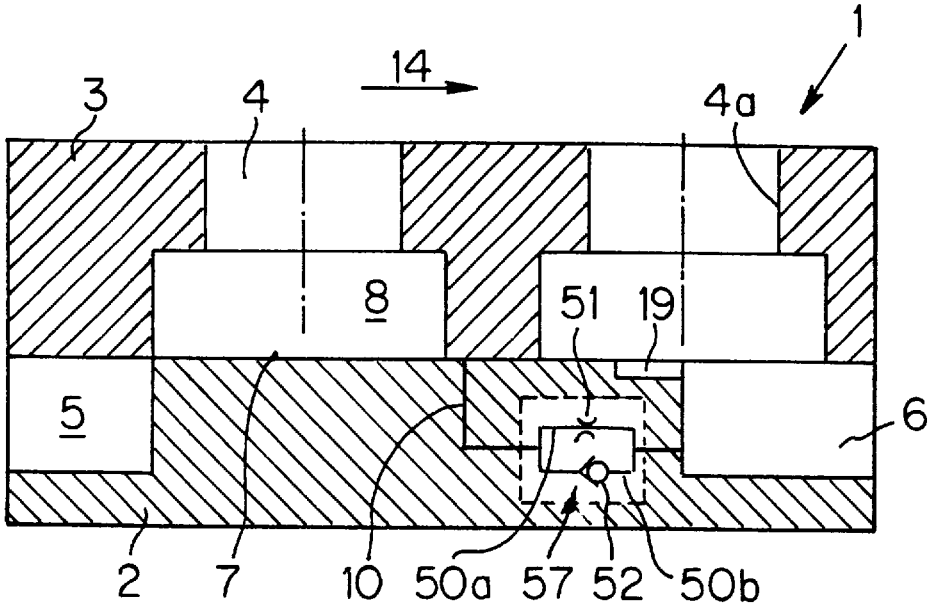
FIGS. 10 and 11 are cross-sections though a control plate of a hydrostatic positive displacement unit with a pre-compression device according to the present invention.
Figure 11:
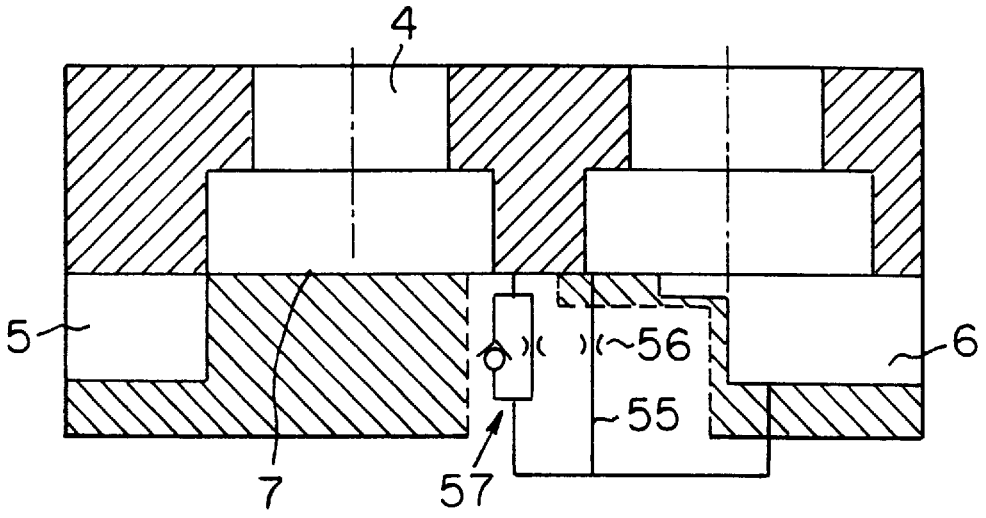

FIGS. 10 and 11 show a control plate 2 of a positive displacement unit, whereby the web 7 between the control nodules 5 and 6 is a pre-compression zone. In this case, the control nodule 5 represents the hydraulic fluid inlet which is pressurized at low pressure. To improve the reversing actions, there is a connecting channel 10 located in the pre-compression zone which branches into a segment 50*a* and a segment 50*b* and creates a connection between the pre-compression zone and the high-pressure side. In segment 50*b* of the connecting channel 10, there is a non-return valve 52 which opens toward the outlet side. Parallel to the non-return valve 10, there is a throttling component 51 in segment 50*a*. As a result of the parallel switching of the non-return valve and the throttling component 51, a one-way restrictor valve 57 is formed which can easily be integrated into the control plate of the positive displacement unit.

In the positive displacement unit illustrated in FIG. 11, in addition to the one-way restrictor valve 57, there is an additional connecting channel 55 which contains a throttling component 56.

When a cylinder chamber 4 moves in the direction 14, hydraulic medium flows out of the control nodule 5 into the cylinder chamber 4 as long as the cylinder chamber 4 is in communication with the control nodule 5. As soon as the control slot 8 closes the control nodule 5, the cylinder chamber 4 moves along the web 7 and thus the pre-compression zone, whereby the fluid inside the cylinder chamber 4 is compressed by the stroke of the piston. As soon as the control slot 8 exposes the opening in the control plate 2 to the connecting boring 10, there is a pressure equalization between the pressure in the cylinder chamber 4 and the pressure on the outlet control nodule 6. If the pressure resulting from the pre-compression in the cylinder chamber 4 is greater than the pressure on the control nodule 6, the non-return valve 52 opens, whereupon the cylinder 4 is in communication with the control nodule 6 via the connecting channel 10, the segment 50*b* and the non-return valve 52.

If the pressure in the cylinder chamber 4 does not exceed the pressure on the control nodule 6, the cylinder chamber 4 is in communication with the control nodule 6 by means of the connecting channel 10, the segment 50*a* and the throttling component 51. The result is an equalization of the pressure in the cylinder chamber 4 and the pressure on the control nodule 6.

As the cylinder chamber 4 moves further in the direction 14, the cylinder chamber opens directly into the high-pressure control nodule 6. As a result of the pressure equalization between the cylinders 4 and the outlet side control nodule 6, only slight pulsations occur. There is a pilot notch 19 on the control nodule 6 to slowly reduce any remaining pressure differential which may be present.

On positive displacement units with a pre-compression zone which operate against pressures of different levels on the outlet side, the reversing actions are further optimized and thus the pulsation is effectively minimized in a broad bandwidth of operating conditions. Therefore only a small amount of vibration and noise is generated on the positive displacement units.

The reversing action can be further improved by using a plurality of connecting channels. On positive displacement units which are also operated as motors, a corresponding layout of the connecting borings can prevent the pressure in the cylinder chambers 4 from increasing to an excessive value as a result of the pre-compression during a movement from the high-pressure control nodule 5 to the low-pressure control nodule 6.

It will be apparent to those of ordinary skill in the art that various modifications may be made to the present invention without departing from the spirit and scope thereof. The scope of the present invention is defined by the appended claims and equivalents thereto.

We claim:

1. A device to reduce pulsations on a hydrostatic positive displacement unit which can be used both as a pump and as a motor with a reversible direction of rotation, wherein the positive displacement unit includes at least one piston mounted so that it can move longitudinally in a cylinder bore forming a cylinder chamber, the device comprising:

a buffer element;

a connecting channel which intermittently brings the buffer element into communication with the cylinder chamber during rotation of the positive displacement unit;

at least one additional connecting channel which connects the cylinder chamber with either the buffer element or with a control nodule of the positive displacement unit; and a throttling device located in the at least one additional connecting channel.

2. The device as claimed in claim 1 wherein the buffer element is a hydropneumatic buffer.

3. The device as claimed in claim 2 wherein the buffer element a gas buffer with a membrane which separates a fluid space from a gas space.

4. The device as claimed in claim 1 wherein the buffer element has an oil-filled chamber with a flexible containment wall.

5. The device as claimed in claim 4, wherein the flexible wall is under a gas pressure.

6. The device as claimed in claims 1 wherein the buffer element has an oil-filled space and flexible elements inserted into said space.

7. A device to reduce pulsations on a hydrostatic positive displacement unit which can be used both as a pump and as a motor with a reversible direction of rotation, wherein the positive displacement includes at least one piston mounted so that it can move longitudinally in a cylinder bore forming a cylinder chamber, the device comprising:

a pre-compression device creating a connection between the cylinder chamber of the displacement unit and the high-pressure side of the displacement unit as soon as the pressure in the cylinder chamber exceeds the pressure on the high-pressure side of the displacement unit;

a one way valve located between a low-pressure side of the displacement unit, the one way valve opening toward the high-pressure side of the displacement unit; and a throttling device located parallel to the one way valve.

8. The device as claimed in claim 7 wherein the pre-compression device is a pre-compression zone and has a connecting channel which is in communication with the high-pressure side of the displacement unit, wherein the connecting channel has two channel segments located parallel to one another, wherein the valve is located in a first channel segment and the throttling device is located in a second channel segment.

9. The device as claimed in claim 8 wherein at least one additional connecting channel provided with a throttling device branches off from the connecting channel.

10. The device as claimed in claim 7 wherein the throttling device is an orifice.

11. The device as claimed claim 8 wherein a pilot notch is located on the connecting channel.

12. A device to reduce pulsations on a hydrostatic positive displacement unit which can be used both as a pump and as a motor with a reversible direction of rotation, wherein the positive displacement unit includes at least one piston mounted so that it can move longitudinally in a cylinder bore forming a cylinder chamber, the device comprising:

a buffer element;

a connecting channel intermittently brings the buffer element into communication with the cylinder chamber during rotation of the displacement unit;

means for increasing the capacity of the buffer element.

13. The device of claim 12 wherein the means for increasing the capacity of the buffer element includes a flexible membrane in the buffer element which is under gas pressure.

14. The device of claim 12 wherein the means for increasing the capacity of the buffer element includes an oil filled space in the buffer element with flexible elements inserted into the space.

* * * * *

UNITED STATES PATENT AND TRADEMARK OFFICE

CERTIFICATE OF CORRECTION

PATENT NO. : 6,086,336

DATED : July 11, 2000

INVENTOR(S) : Bernward WELSCHOF et al.

It is certified that error appears in the above-identified patent and that said Letters Patent is hereby corrected as shown below:

Title Page ABSTRACT [57] Line 2 "units" should read --unit--.

Title Page ABSTRACT [57] Line 15 after "chamber" insert --,--.

Column 10 Line 3 "are" should read --is--.

Column 10 Line 4 "connect" should read --connects--.

Column 10 Line 23 "improve" should read --improves--.

Claim 3 Column 12 Line 25 after "element" insert --has--.

Claim 6 Column 12 Line 32 "claims" should read --claim--.

Claim 12 Column 13 Line 8 after "unit;" insert --and--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*